US005423597A

United States Patent [19]

Rogers

[11] Patent Number: 5,423,597

[45] Date of Patent: Jun. 13, 1995

[54] CHILDREN'S MODULAR FURNITURE

[76] Inventor: Michael L. Rogers, 9519 Winkler Dr., St. Louis, Mo. 63136

[21] Appl. No.: 934,797

[22] Filed: Aug. 24, 1992

[51] Int. Cl.[6] ..... A47C 7/62

[52] U.S. Cl. ..... 297/440.1; 5/2.1; 5/6; 297/135; 297/170; 297/338; 297/440.14

[58] Field of Search ..... 297/440.1, 440.13, 440.14, 297/170, 135, 174, 192, 338; 5/2.1, 3, 6

[56] References Cited

U.S. PATENT DOCUMENTS

| | | | |
|---|---|---|---|
| D. 174,900 | 6/1955 | Flexer et al. | D15/11 |
| 235,032 | 11/1880 | Singer | 5/6 X |
| 2,245,768 | 6/1941 | Ferrary | 297/440.13 X |
| 2,584,642 | 2/1952 | Tuttle | 297/338 |
| 2,606,380 | 8/1952 | Buhr et al. | 297/174 |
| 2,701,009 | 2/1955 | Richard . | |
| 2,813,575 | 11/1957 | Bode . | |
| 2,888,976 | 6/1959 | Hart | 297/338 |
| 2,899,691 | 8/1959 | Davis et al. . | |
| 3,221,348 | 12/1965 | Siegel | 297/248 |
| 3,230,005 | 1/1966 | Staples | 297/440.1 X |
| 3,233,942 | 2/1966 | Creutz | 297/440.14 X |
| 3,241,885 | 3/1966 | Deaton | 297/135 |
| 3,316,018 | 4/1967 | Stith | 297/440.1 |
| 3,517,471 | 6/1970 | Lindmark | 411/457 X |
| 3,600,036 | 8/1971 | Iskander | 297/239 |
| 3,669,494 | 6/1972 | Lohmeyer | 297/248 X |
| 3,811,728 | 5/1974 | Redemske . | |
| 3,944,282 | 3/1976 | Nakamura | 297/440.14 |
| 3,955,850 | 5/1976 | Toso | 297/440.14 |
| 4,077,666 | 3/1978 | Heumann | 297/440.14 |
| 4,091,746 | 5/1978 | Kimbrough | 297/440.13 X |
| 4,131,314 | 12/1978 | Knapp et al. | 297/440.1 X |
| 4,153,958 | 5/1979 | Paulik | 5/12 R |
| 4,674,631 | 6/1987 | Williams | 206/216 |

FOREIGN PATENT DOCUMENTS

| | | | |
|---|---|---|---|
| 224293 | 11/1962 | Austria | 5/6 |
| 1958655 | 5/1971 | Germany | 297/338 |

*Primary Examiner*—Lloyd A. Gall

*Attorney, Agent, or Firm*—Rogers, Howell & Haferkamp

[57] ABSTRACT

Assembly components are provided for children to build and rebuild their own assemblies of school furniture. The assembly components include, as general categories, base components and interchangeable auxiliary components. The auxiliary components can be releasably coupled with the base components to build school-related assemblies including chair assemblies with adjustably high seating surfaces; a notice board assembly for supporting notices or a chalk board or the like; a stage assembly for theatrical productions; symbol display assemblies, as for displaying the alphabet in block letters; and desk assemblies with adjustably high desk tops. In some embodiments of the present invention, the furniture base is not just a unitary component but an assembly of modules. Accordingly, there are modules which can be releasably coupled together to build a modular assembly of a furniture base. The modular base assembly, in turn, can be releasably coupled with several different auxiliary components to build a variety of assemblies including chair assemblies, desk assemblies, drawing board assemblies, sofa assemblies, and bed assemblies.

8 Claims, 4 Drawing Sheets

CHILDREN'S MODULAR FURNITURE

BACKGROUND OF THE INVENTION

1. Field of the Invention

The present invention relates to children's modular furniture, and more particularly relates to components for children at home or at school to assemble and reassemble into multiple assemblies of their own furniture for multiple, school-related purposes.

2. Description of the Related Art

Furniture assemblies to which the present invention generally relates are known in the art. Typical known furniture assemblies comprise modules which can be coupled together to build modular assemblies of furniture bases. The modular assemblies of furniture bases are then set on the floor and serve as platforms for supporting several different auxiliary components. The modular assemblies of furniture bases and the auxiliary components couple together to build different assemblies of furniture, like a chair, a sofa, a table and so on.

One of the known furniture assemblies begins with a module, for the furniture base assembly, which has a rectangular bottom edge for sitting on the floor, a rectangular top surface positioned above the bottom edge, and a four-sided wall interconnecting the top surface with the bottom edge. The top surface is recessed with several criss-crossed slots. The top surface is also recessed along the four sides of its perimeter with slender, rectangular openings. For coupling two such modules together, there are inverted-U shaped clips, with legs having cross-sections in the shape of slender rectangles, for insertion one apiece into the slender, rectangular openings of the top surfaces. Thus two modules can be coupled together to build a modular assembly of a furniture base. This known furniture assembly further includes several kinds of auxiliary components, for releasably coupling with the furniture base. Some auxiliary components couple with the furniture base to build chair or sofa assemblies. Still others build table, shelf or bed assemblies. For coupling purposes, each auxiliary component has a downwardly extending, stubby flange looped around in a rectangle, for insertion into the criss-crossed network of slots in the top surfaces of the furniture base. A furniture assembly like that above is shown by U.S. Pat. No. 3,811,728.

The children's modular furniture of the present invention is an improvement over the prior art. To begin with, the children's modular furniture of the present invention is scaled to size for children. More importantly, the assembled components of the present invention assemble to make furniture assemblies with adjustable sizes, for the needs of differently sized children. The problem involved here is that children generally, and particularly children below the age of six, differ in relative sizes among one another much more so than do adults. To solve that problem, the children's modular furniture of the present invention provides adjustably high chair seats and desk tops for children in widely ranging size groups.

Other shortcomings of the prior art relate to how the prior art furniture assemblies are put together: the prior art assemblies generally fix together in ways too difficult for small children to manage without an adult's help. In particular, the strength required to force the components together is generally more than what a small child will possess. A related shortcoming, the reverse of that last point, is that the prior art assemblies also appear to require more strength for forcing the components apart than small children will generally possess.

Still other shortcomings of the prior art furniture assemblies relate to the degree of intellect required to solve the puzzle of how it is that the components assemble together. For children, building their own school furniture is itself an important activity, for the twin effects of developing motor coordination and developing problem-solving skills. But if the puzzle is too difficult, such that children must be helped by adults, those effects are unrealized.

Still more shortcomings of the prior art relate to the weight of the individual components. That is, the auxiliary components must be light enough for the children to be able to lift above and manipulate onto the furniture bases. Further, the furniture bases must be light enough for the children to be able push and slide across the floor.

Still further shortcomings of the prior art relate to the uses to which the prior art furniture assemblies can be put. The children's modular furniture of the present invention builds not only chair and bed assemblies, but also desk and stage assemblies, as well as various other assemblies for displaying school lessons. Indeed, all the resultant furniture assemblies of the present invention have particular utility for such learning environments that can be typically associated with school, pre-school and day-care centers, indeed the home as well.

SUMMARY OF THE INVENTION

In accordance with one embodiment of the present invention, there is a unitary furniture base component and there are several interchangeable auxiliary components for releasably coupling with the furniture base to build several different furniture assemblies, namely: chair assemblies with adjustably high seating surfaces; a notice board assembly for supporting notices, or a chalk board, or the like; a stage assembly for theatrical productions; and a symbol display assembly, as for displaying the alphabet in block letters.

The unitary furniture base component, more particularly, generally has a rectangular block shape including a top surface and four vertical sides. This furniture base has a slot recessed into the top surface, extending laterally from side-to-side.

As for the auxiliary components, they generally have main bodies, and further have stems extending downwardly from their main bodies for insertion into the slot of the base. Among the auxiliary components, there is a chair back component which couples together with the furniture base to make a chair assembly. There is also a chair seat component, likewise coupling together with the furniture base to make a chair assembly, but with a seating surface located in a higher elevation than the seating surface of the previous chair assembly. The auxiliary components further include a slot-covering component for coupling together with the furniture base, to build a stage assembly. In addition, there are symbol display components, like a block letter "A" or "B" and so on, for coupling together with the furniture base to make a symbol display assembly; and then there is a notice board component, for making a notice board assembly.

In another embodiment of the present invention, the furniture base, as generally described above, is furthermore provided with a T-slot recessed into one of the vertical sides, extending laterally, side-to-side, and parallel to the floor. For coupling with this base, there are further auxiliary components specially adapted with the provision of T-slides. That is, there is a desk component with a desk top portion, a T-slide provision spaced vertically below the desk top portion, and an inclined leg interconnecting the desk top portion with the T-slide provision. Accordingly, the desk component can couple together with the furniture base to make a desk assembly, for such a user who would sit on the furniture base while using the desk. Another embodiment of the desk component has a vertical leg, rather than inclined, interconnecting the desk top portion with the T-slide provision.

In yet another embodiment of the present invention, the furniture base is no longer unitary, but an assembly of modules. Accordingly, the modules can be releasably coupled to build a modular assembly of a furniture base, which in turn can be releasably coupled together with suitably adapted auxiliary components to build assemblies of school furniture. The typical module generally has a rectangular block shape, including four sides and a top surface. The typical module also has a notch recessed therein, eliminating what would otherwise have been a sharp corner between the top surface and one particular side. In addition, on that one particular side, the module is formed with tongue and groove provisions that extend vertically between the notch and bottom edge.

That module just described can be coupled together with different auxiliary components, for making different assemblies of furniture, like a chair, container or drawing board assembly. Thus, there is another embodiment of an auxiliary component that provides a chair, the chair auxiliary having a main body, and a stem subjoined thereto for engaging the groove of the module. Another auxiliary component is a drawing board component, with an inclined drawing board surface supported by a column likewise shaped for engaging the groove of the module. When a user of these auxiliaries is provided with two like modules, that user can have, at the same time, both a drawing board assembly and a chair assembly: that is, one assembly on which to sit while working at the other.

Another embodiment of a module for building modular assemblies is similar to the module above but further has a tongue or groove provision on a second side of the module, perpendicular to the side formed with the first tongue and groove provisions mentioned above. By all of these tongue and groove provisions, four modules can be releasably coupled together to make a modular base assembly. Thus, this last modular base assembly differs from the first in constituting four interlinked modules rather than two.

The four-module base assembly, in turn, can be releasably coupled with several different auxiliary components, namely: still other embodiments of a chair component, other embodiments of a desk component, and a mattress and tray assembly.

To turn to those listed auxiliary components, one-by-one, the chair component includes a generally vertically extending member, and a chair seat portion with opposite, front and back edges. The front edge has a flange turned down from it. The back edge merges in a T-intersection with the generally vertically extending member, the generally vertically extending member defining a chair back above the T-intersection and a flange below. Accordingly, the chair component couples together with the furniture base assembly by the insertion of the top surface of a module in through the downwardly extending flanges of the front and back edges.

The embodiments of the desk component have T-slide provisions rigidly interconnected with a desk top by an interconnecting leg. Correspondingly, the furniture base assembly presents at least one vertical side recessed with a T-slot, extending across that side laterally. By those T-slot and T-slide provisions, the embodiments of the desk component can be releasably coupled together with the four-module base assembly to make a desk assembly.

The four-module base assembly is furthermore provided with a rectangular cavity, extending laterally therethrough, functioning much like a drawer cavity. This cavity provides for the storage of the previously mentioned mattress and tray assembly. The mattress and tray assembly has two assembly positions: folded in and folded out. While folded in, the mattress and tray assembly stores away inside the cavity. While folded out, the mattress and tray assembly covers over the top of the furniture base assembly, for converting the furniture base assembly into a bed that children can recline on.

Another improvement of the present invention concerns still another embodiment of a desk component, this embodiment having several T-slots recessed in a vertical leg at spaced elevations. In conjunction with an H-shaped slide and the previously mentioned T-slotted furniture base assembly, this other embodiment of a desk component can releasably couple together with the furniture base assembly to provide a desk top at adjustable elevations.

Still another improvement of the present invention relates to chair seat elevators, for stacking upon one another or upon the seating surface of a chair assembly, to provide a seating surface at adjustable elevations.

BRIEF DESCRIPTION OF THE DRAWINGS

Further objects and features of the present invention are revealed in the following detailed description of the preferred embodiments of the invention and the drawing figures wherein.

DESCRIPTION OF THE PREFERRED EMBODIMENTS

Figure 1:
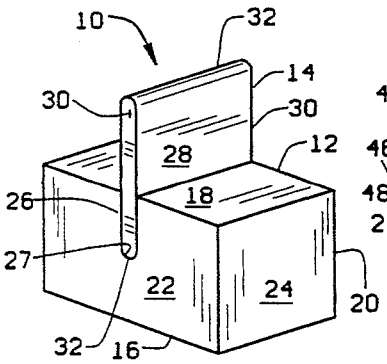
FIG. 1 is a perspective view of a notice board assembly of the present invention, shown comprising a furniture base releasably coupled with a notice board.

In FIG. 1, a notice board assembly 10 of the present invention is shown. The notice board assembly 10 comprises a furniture base 12 for sitting on a floor, and a notice board 14 releasably coupled with the furniture base 12. The notice board 14 can be provided with a surface texture that permits children to draw on it in marker, or to stick cut-out figures to it. Alternatively, the notice board 14 can provide support for a bulletin board, a chalk board, or the like (not illustrated). Although the furniture base 12 and notice board 14 are shown coupled together, it is to be understood that they are neither locked nor glued tightly together, but can be easily uncoupled by a small child, without the help of adults.

The furniture base 12 generally has a rectangular block shape. More particularly, the furniture base 12 includes a rectangular bottom surface 16 for engaging a floor, and a top surface 18 positioned above the bottom surface 16. The bottom surface 16 and top surface 18 are interconnected by a vertical, generally continuous wall 20. The wall 20 has four sides, namely: mirror opposite long sides 22 laterally spaced apart by mirror opposite short sides 24 (of which only one of each of the opposite pairs of sides are in view in FIG. 1).

The furniture base 12 furthermore has a slot 26 recessed into the top surface 18, extending laterally between the opposite, laterally spaced long sides 22. The slot 26 has a rounded bottom or seat 27. The slot 26 may be midway between the sides 24.

The notice board 14 is a generally rectangular plate with opposite front and back surfaces 28 spaced apart by four edges, namely opposite flat edges 30 and opposite rounded edges 32.

The furniture base 12 and notice board 14, as said, are shown releasably coupled together. For that purpose, the slot 26 is shaped and sized to complement the thickness of the notice board 14 so that the slot 26 can removably receive and retain the notice board 14 therein. The notice board 14 is retained in the slot 26, not by locking mechanisms nor glue, but by a fit that accords with a small child's ability to couple/uncouple the furniture base 12 and notice board 14 together. Because the opposite edges 32 of the notice board are of identical rounded shape and size, either edge 32 can be inserted into the slot 26. Either edge 32 will seat against the rounded seat 27. Further, the rounded shape of the edge 32 makes it easier for a child to handle the notice board 14, and easier for the child to initiate insertion of the notice board 14 into the slot 26 as the rounded edge 32 tends to guide the board as it is introduced into the slot.

Figure 2:
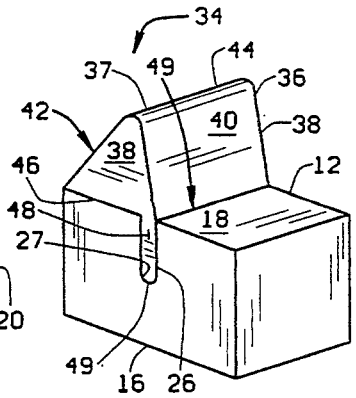
FIG. 2 is a perspective view of a chair assembly of the present invention, illustrating the same furniture base of FIG. 1 but with a chair back that has been interchangeably substituted for the notice board above and releasably coupled with the furniture base.

In FIG. 2, a chair assembly 34 of the present invention is shown. The chair assembly 34 comprises the same furniture base 12 of FIG. 1, this time releasably coupled with a chair back 36 that can be interchangeably substituted for the notice board 14.

The chair back 36 generally has a wedge-shaped main body 37, with opposed triangular sides 38 laterally spaced by both an inclined front side 40 and an inclined back side 42. The inclined front side 40 and inclined back side 42 intersect at an upper, rounded edge 44, and diverge away from each other in the downward direction. The laterally opposite, triangular sides 38 and the inclined back side, 42 coordinately terminate as a flat bottom surface 46 (only a side edge of which is shown in FIG. 2).

In addition to the main body 37 described above, the chair back 36 further includes a stem 48, extending vertically below the bottom surface of the inclined front side 40. The stem 48 has a rounded lower edge 49, and the size and shape of the stem 48 and edge 49 are complementary to the size and shape of the slot 26 and seat 27.

As shown in FIG. 2, the furniture base 12 and chair back 36 are releasably coupled together. For that purpose, the stein 48 is coordinately sized for removable insertion into the slot 26, until the bottom surface 46 of the chair back 36 engages the top surface 18 of the furniture base 12 and simultaneously, the edge 49 engages the seat 27.

For the chair assembly 34, the inclined front side 40 of the chair back 36 functions as the back rest, while about half of the top surface 18 functions as the seating surface. For the seating surface function, the elevation of the top surface 18 in relation to the bottom edge 16 of the base 12 is selected to be comfortable for children.

But children, more so than adults, differ greatly in size among one another. Which means, no single seating surface elevation is going to be characteristically comfortable for children of wide ranges of sizes. In the art, it is presupposed that children's size groups correspond roughly to age groups. More particularly, it is presupposed that seat elevations comfortable for 2 year old children should be 8 inches; for 3 year old children, 10 inches; and for 4–5 year old children, 12 inches. See, J. Greenman., *Caring Spaces, Learning Places: Children's Environments That Work* 123 (Exchange Press 1988). Accordingly, the elevation of the top surface 18 above the bottom edge 16 is selected for the comfort of the youngest age group that the chair assembly 34 is intended to be used by.

Figure 3:
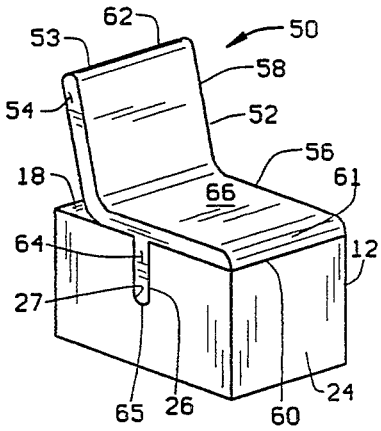
FIG. 3 is a perspective view of another chair assembly of the present invention, illustrating the same furniture base of FIGS. 1 and 2 releasably coupled with a chair seat.

To turn now to FIG. 3, another chair assembly 50 of the present invention is shown. The chair assembly 50 comprises the same furniture base 12 of FIGS. 1 and 2, this time releasably coupled with a chair seat 52.

The chair seat 52 generally has an L-shaped main body 53 laterally extending between opposite, L-shaped edges 54. The L-shaped main body 53 includes a horizontal portion 56 that generally functions as a seat, and further includes an upwardly, rearwardly inclined portion that generally functions as a back rest 58. The horizontal portion 56 has a terminal, front edge 60 laterally extending between the opposite edges 54. The front edge is preferably formed with a curved bevel margin 61. The edge 60 aligns with the adjacent wall 24 and the curved bevel margin 61 provides comfort under a child's knees. The back rest 58 has a terminal, upper edge 62 that likewise extends laterally between the opposite edges 54. Moreover, the chair seat 52 has a subjoined stem 64 extending laterally between the opposite edges 54, and across the underside of the horizontal portion 56, as shown. The stem 64 has a rounded lower edge 65.

The stem 64 and edge 65 of the chair seat 52 are sized and shaped for removable insertion into the slot 26. The stem 64 and slot 26 cooperate for purposes of locating the chair seat 52 in a fixed position relative to the furniture base 12, thus preventing relative sliding or rotation.

As shown by FIG. 3, the seating surface 66 of the chair assembly 50 is atop the horizontal portion 56 of the chair seat 52. The seating surface 66 of the FIG. 3 chair assembly 50 is higher than the seating surface of the FIG. 2 chair assembly 34 because of the thickness of the horizontal portion 56 as stacked upon the top surface 18. For children's chair assemblies, adjustable seat elevations are advantageous. As said, it is presupposed that 2 year old children would be comfortable with 8 inch high seat elevations, while 3 year old children would be comfortable with 10 inch high seat elevations. And so if the seat elevation is adjustable by just two inches, that should make a difference in comfort between a child of two and a child of three.

Corresponding to the higher seat elevation of the FIG. 3 chair assembly 50, as over the FIG. 2 chair assembly 34, the fore-to-aft extent of the seating surface 66 is also greater than the comparable fore-to-aft extent for the FIG. 2 chair assembly 34. The purpose behind the "deeper" seating surface 66 of the FIG. 3 chair assembly 50 over the FIG. 2 chair assembly 34 again relates to comfort. That is, since it is supposed that the FIG. 3 chair assembly 50 is for bigger children than the FIG. 2 chair assembly 34, the seating surface 66 is correspondingly deeper for the comfort of those bigger children.

Figure 4:
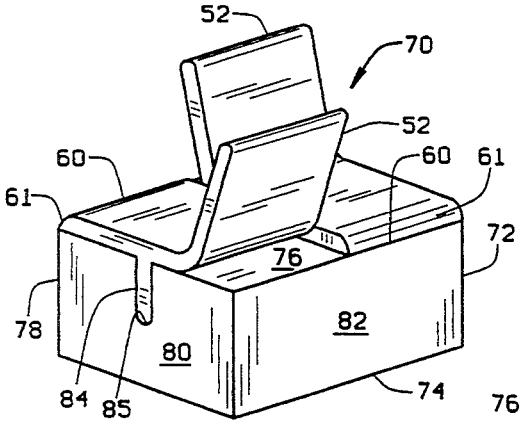
FIG. 4 is a perspective view of yet another chair assembly of the present invention, comprising a furniture base like the furniture base of FIGS. 1–3, but longer, releasably coupled with a pair of chair seats like that of FIG. 3.

In FIG. 4, yet another chair assembly 70 is shown. The chair assembly 70 comprises a furniture base 72 similar to the furniture base 12 of FIGS. 1–3, but longer. The furniture base 72 is releasably coupled with a pair of the chair seats 52 of FIG. 3.

The longer furniture base 72 has a rectangular bottom surface 74, a top surface 76 positioned above the bottom surface 74, and a generally continuous wall 78 interconnecting the bottom surface 74 with the top surface 76. The wall 78 like the wall 20 in FIG. 1, also has four sides, but with different proportions, namely: there are opposite short sides 80 laterally spaced apart by opposite long sides 82.

The longer furniture base 72 furthermore has a slot 84 recessed in the top surface 76, extending laterally between the opposite, laterally spaced short sides 80. The bottom or seat 85 of the slot 84 is rounded. Preferably the slot 84 is generally midway between the sides. Such a slot location provides the assembly 70 with reversibility. That is, either or both long sides 82 can be "forwardly" facing sides. Accordingly, two chair seats 52 can be coupled together with the longer furniture base 72, one chair seat 52 facing a direction reverse to the other, yet each having a front edge 60 extending to a line about even with an adjacent long side 82 of the longer furniture base 72.

Figure 5:
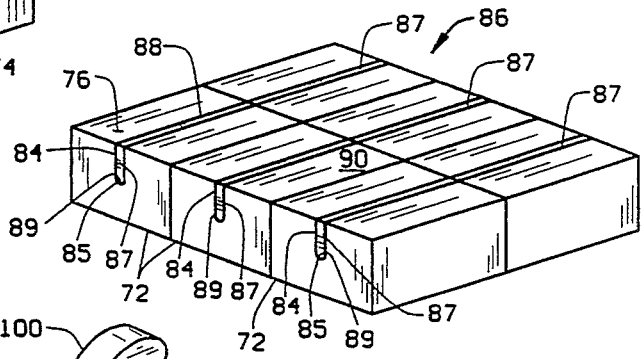
FIG. 5 is a perspective view of a stage assembly of the present invention, illustrating a plurality of the longer furniture bases of FIG. 4 releasably coupled together with a slot-covering component.

To turn now to FIG. 5, a stage assembly 86 of the present invention is shown. The stage assembly 86 comprises a plurality of the longer furniture bases 72 of FIG. 4, each of which is releasably coupled with a slot-filling component 87. The slot-filling component 87 has a flat top edge 88 and a rounded bottom edge 89. The slot-filling component 87 and its bottom edge 89 are sized and shaped to complement the size and shape of the slot 84 and seat 85. The height of the slot-filling component 87, which solidly fills the slot 84, in such that the flat top edge 88 is flush with the top surface 76. While the longer furniture bases 72 and the slot-filling components 87 are coupled together so, the stage assembly 86 is provided with a generally solid, upwardly facing stage surface 90. Any number of bases 72 and slot-filling components 87 can be used according to the stage size desired.

Figure 6:
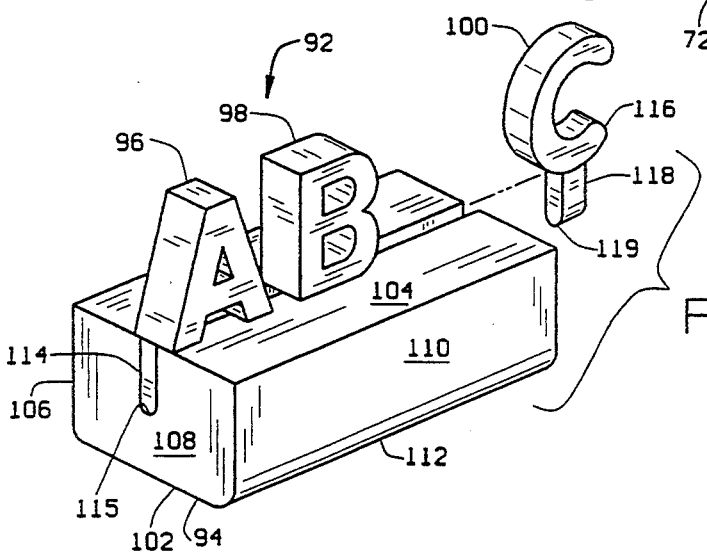
FIG. 6 is a perspective view of a symbol display assembly of the present invention, comprising a furniture base like the furniture base of FIGS. 4 and 5, but longer, releasably supporting components shaped as alphabet symbols.

With reference to FIG. 6, a symbol display assembly 92 is shown. The symbol display assembly 92 comprises a furniture base 94 that is similar to the furniture base 72 of FIGS. 4 and 5, but longer. The furniture base 94 is releasably coupled with a pair of auxiliary components, namely: a block letter "A" 96 and a block letter "B" 98. Also, in FIG. 6, a block letter "C" 100 is shown, illustrating typical features that are shared with the "A" and "B" blocks 96 and 98, but are hidden from view.

The furniture base 94 has a rectangular bottom surface 102, a top surface 104 positioned above the bottom surface 102, and a wall 106 interconnecting the bottom surface 102 with the top surface 104. The wall 106 has opposite short sides 108 laterally spaced by opposite long sides 110. The bottom surface 102 has rounded, rather than sharp, front and rear edges 112.

The opposite edges 112 of the bottom surface 102 are rounded for making the furniture base 94 easier for small children to transport. For children, the favored method of transporting the furniture base 94 often is by pushing the furniture base 94 to slide across a floor. With the edges 112 rounded as shown, the furniture base 94, while being pushed so, will be less likely to plow the floor, especially a carpeted floor.

The furniture base 94 additionally has a slot 114 recessed into the top surface 104, extending laterally between the opposite, laterally spaced short sides 108. The bottom or seat 115 of the slot is rounded. The slot 114 may be midway between the sides 110.

The block 100 for the letter "C", as typical of the blocks 96 and 98 for the letters "A" and "B", comprises a main (C-shaped) body 116, with a stem 118 subjoined thereto. The stem 118 has a rounded lower edge 119. So that the block 100 can releasably couple with the furniture base 94, the stem 118 and edge 119 are sized for removable insertion into the slot 114, until the lower extremity of the main (C-shaped) body 116 engages the top surface 104 of the furniture base 94 and the edge 119 contacts the seat 115.

Figure 7:
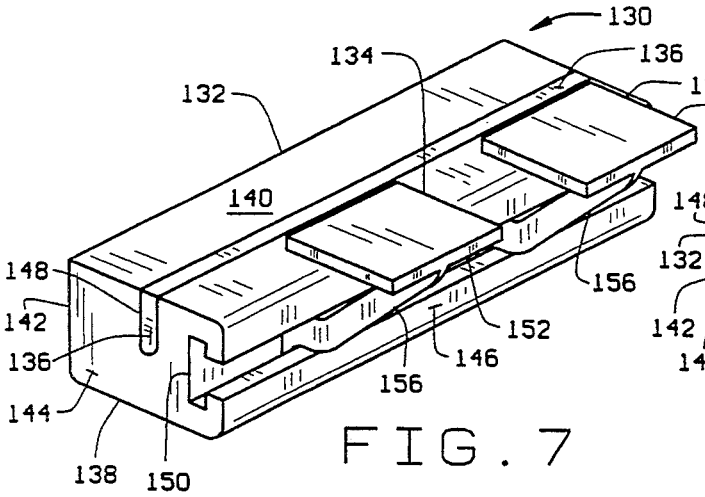
FIG. 7 is a perspective view of a desk assembly of the present invention, comprising an elongated furniture base with a releasable slot covering component and a pair of releasably supported desk components.

FIG. 7 shows a bench desk assembly 130 of the present invention. The bench desk assembly 130 comprises a furniture base 132, which is like the furniture base 94 of FIG. 6, but longer and having two slots. Releasably coupled with the furniture base 132 are not only a pair of identical desk components 134 but also a slot-filling component 136 having a rounded bottom edge 137.

The furniture base 132 has a rectangular bottom surface 138 for sitting on a floor, a top surface 140 positioned above the bottom surface 138, and a wall 142 interconnecting the bottom surface 138 with the top surface 140. The wall 142 has opposite short sides 144 laterally spaced by mirror opposite long sides 146. The furniture base also has a slot 148 recessed in the top surface 140, extending laterally between the short sides 144 and having a rounded seat 149. In addition, this furniture base 132 also has a T-slot 150 recessed in one of the long sides 146, extending laterally between the opposite short sides 144.

Figure 8:
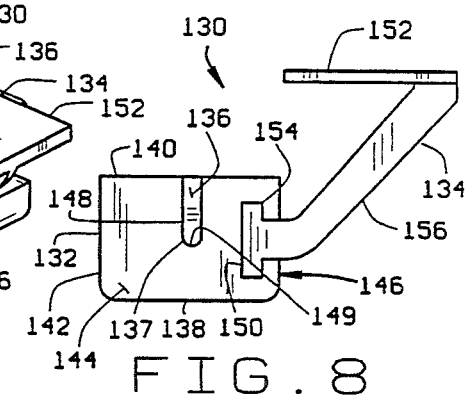
FIG. 8 is a side elevation view of the assembly of FIG. 7.

As better shown by FIG. 8, each of the desk components 134 comprises a desk top portion 152, a T-slide provision 154 spaced below the desk top portion 152, and an inclined leg 156 interconnecting the desk top portion 152 with the T-slide provision 154. The desk components 134 can be coupled together with the furniture base 132 by a sliding engagement between the T-slide provision 154 and the T-slot 150. The desk components 134 can be positioned along any lateral station of the furniture base 132 by the sliding of the T-slide provision 154 in the T-slot 150. In addition, the desk components 134 can be uncoupled (not shown) from the furniture base 132 by sliding the T-slide provision 154 out an open end of the T-slot 150. While the desk components 134 and the furniture base 132 are coupled together the top surface 140 provides a bench seat for users of the desk assembly 130 who are seated in front of the desk components 134.

Figure 9:
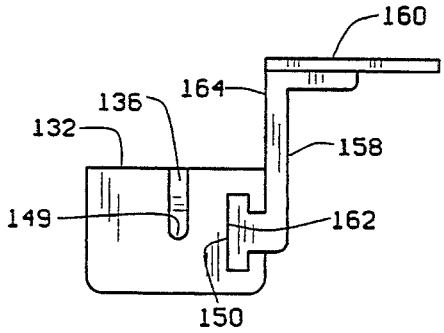
FIG. 9 is generally similar to FIG. 8 except for illustrating another embodiment of the desk component.

In FIG. 9, another embodiment 158 of a desk component is shown, which has an inverted-L cross-section. The desk component 158 of FIG. 9 is shown releasably coupled together with the same furniture base 132 of FIGS. 7 and 8. This desk component 158 comprises a desk top portion 160, a T-slide provision 162 spaced below the desk top portion 160, and a vertically extending leg 164 interconnecting the desk top portion 160 with the T-slide provision 162. The T-slide provision 162 of the desk component 158 generally cooperates with the T-slot 150 of the furniture base 132 in the same way as the T-slide provisions 154 of the desk components 134, for generally the same functions and results.

Figure 10:
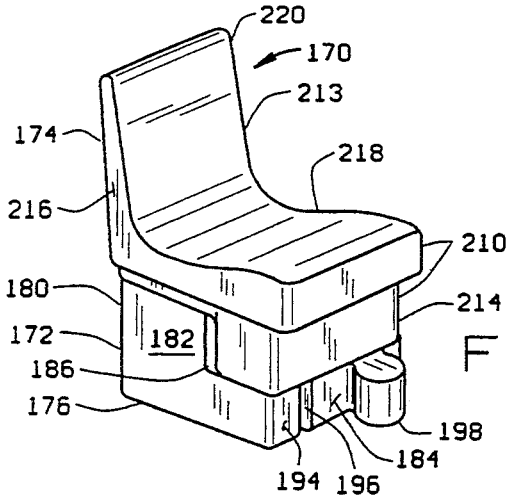
FIG. 10 is a perspective view of still another chair assembly of the present invention, comprising a base module releasably coupled with a chair component.
Figure 11:
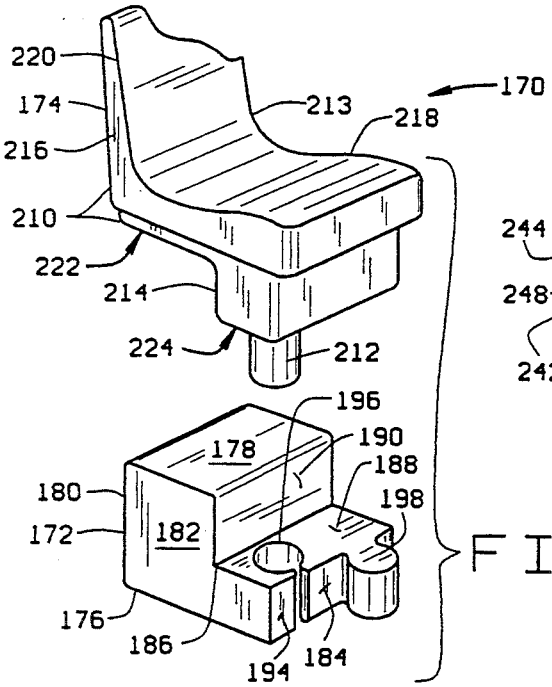
FIG. 11 is an exploded view of FIG. 10.

FIG. 10 shows still another chair assembly 170 of the present invention. The chair assembly 170 comprises a module 172 for building a modular assembly of a furniture base, to be described below, releasably coupled together with a chair component 174. FIG. 11 shows the same module 172 and same chair component 174 uncoupled from each other. The module 172 generally has a rectangular block shape, including a rectangular bottom surface 176, a top surface 178 positioned above the bottom surface 176, and a wall 180 generally interconnecting the bottom surface 176 with the top surface 178. The wall 180 has opposite short sides 182 laterally spaced apart by opposite long sides 184.

The module 172 furthermore has a notch 186 recessed therein. More particularly, the notch 186 is defined by a horizontal step 188 intersecting a vertical riser 190 along a creased corner 192. The particular one of the opposite long sides 184 extending vertically between the bottom surface 176 and step 188 is an inboard side 194.

The module 172 furthermore has a rounded fantailed groove 196 recessed into the inboard side 194, extending vertically between the vertically spaced bottom surface 176 and step 188. Further still, the module 172 has a rounded fan-tailed tongue 198 protruding from the inboard side 194, extending vertically between the vertically spaced bottom surface 176 and step 188. The fantailed groove 196 is generally parallel to and horizontally spaced from the fan-tailed tongue 198, as shown in FIG. 11.

The chair component 174 comprises a main body 210, and a cylindrical stem 212 subjoined to the main body 210. The main body 210 has an L-shaped superstructure 213, and an inverted-L substructure 214 interconnecting the L-shaped superstructure 213 with the cylindrical stem 212.

The L-shaped superstructure 213 extends laterally between opposite,r L-shaped edges 216, providing a generally horizontal seat portion 218 and a generally vertical back rest portion 220. The inverted-L substructure 214 is united with the underside of the seat portion 218, indented from the laterally spaced edges 216 as shown in FIG. 11. The inverted-L substructure 214 has a pair of downwardly facing surfaces establishing a rear level 222 lying in a higher plane than a forward level 224.

The module 172 and chair component 174, as said, are shown releasably coupled together in FIG. 10 and uncoupled from one another in FIG. 11. To do this, the size and shape of the stem 212 of the chair component 174 complements the size and shape of the groove 196 of the module 172, so that the groove 196 can removably receive the stem 212. While the base module 172 and chair component 174 are coupled together, the stem 212 and groove 196 cooperate to prevent relative sliding, as the inverted-L substructure 214 and the notch 186 cooperate to prevent relative rotation. The top surface 178 supports the rear level 222 while the step 188 supports the forward level 224, thus supporting the chair component 174 uprightly and off the floor.

Figure 12:
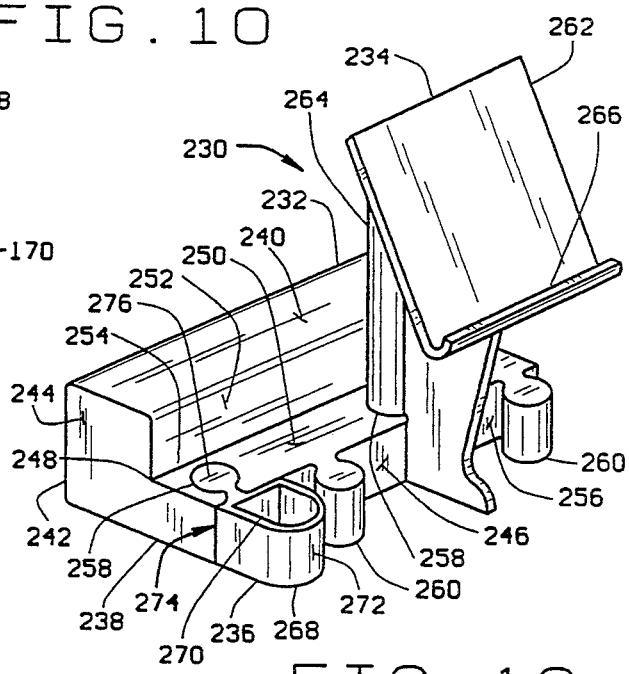
FIG. 12 is a perspective view of a drawing board assembly of the present invention, comprising a base module like the base module of FIGS. 10 and 11, but longer, releasably coupled with a drawing board component, and releasably coupled furthermore with a container component.

In FIG. 12, a drawing board assembly 230 of the present invention is shown. The drawing board assembly 230 comprises a module 232 similar to the base module 172 of FIGS. 10 and 11, but longer, releasably coupled with a drawing board 234. The module 232 is also releasably coupled with a container 236.

The module 232 comprises a generally rectangular bottom surface 238, a top surface 240 positioned above the bottom surface 238, and a four-sided wall 242 interconnecting the bottom surface 238 with the top surface 240. The four-sided wall 242 has opposite short sides 244 laterally spaced by opposite long sides 246. The module 232 has a laterally extending notch 248 recessed therein. The notch 248 is more particularly defined by a horizontal step 250 intersecting a vertical riser 252 along a laterally extending, creased corner 254. The particular one of the opposite long sides 246 interconnecting the step 250 with the bottom surface 238 is an inboard side 256.

The module 232 of FIG. 12 is provided with a pair of rounded fan-tailed grooves 258 recessed into the inboard side 256, extending vertically between the step 250 and bottom surface 238. The module 232 also has a pair of rounded fan-tailed tongues 260 protruding from the inboard side 256, extending vertically beside and in alternately spaced relationships with the fan-tailed grooves 258, as shown in FIG. 12.

The drawing board 234 comprises a rectangular panel 262 supported above the floor at an incline by a support column 264. The inclined rectangular panel 262 has a lower margin 266 turned upwardly to create a tray for storing crayons and other like writing utensils. The support column 264 has a rounded fan-tailed cross-section. Accordingly, the fan-tailed cross-section of the support column 264 can be releasably coupled with either of the fan-tailed grooves 258 of the module 232.

Also in ]FIG. 12, there is the container 236, which has a closed bottom surface 268 for sitting on the floor, an open top surface 270 positioned above the bottom surface 268, and a wall 272 interconnecting the bottom surface 268 with the top surface 270. The wall 272 has at least one generally flat side 274, with a rounded fan-tailed tongue 276 protruding from the flat side 274, extending vertically between the top surface 270 and bottom surface 268. Thus the container 236 can be releasably coupled with the module 232 by the sliding insertion of the fan-tailed tongue 276 into either of the fan-tailed grooves 258.

Figure 13:
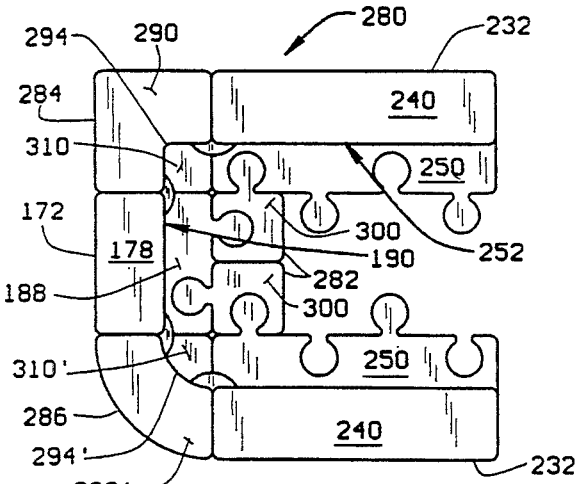
FIG. 13 is a plan view of a modular assembly of another embodiment of the present invention.

With reference now to FIG. 13, a modular assembly 280 of the present invention is shown. The modular assembly 280 comprises several kinds of modules, including the module 172 of FIGS. 10 and 11 as well as the longer module 232 of FIG. 12. In addition, the modular assembly 280 comprises a pair of identical, interior corner modules 282, one exterior corner module 284 with four flat sides, and another exterior corner module 286 with one curved side substituted for two of the flat sides of the previous exterior corner module 284.

Figure 14:
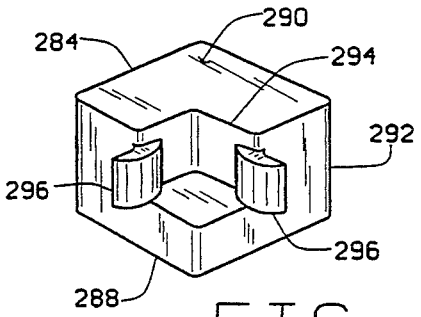
FIG. 14 is a perspective view of one of the two embodiments of exterior corner modules of the modular assembly of FIG. 13.

The exterior corner module 284 with four flat sides, as better shown by FIG. 14, has a generally square bottom surface 288, a top surface 290 positioned above the bottom surface 288, and a four-sided wall 292 interconnecting the bottom surface 288 with the top surface 290. The exterior corner module 284 has a notch 294 formed therein, defining a right-solid angle. The exterior corner module 284 also has a pair of gripping arms 296, perpendicular to one another and extending outwardly from the notch 294. As shown by FIG. 13, the exterior corner module 284 can be releasably coupled with the module 172 and the perpendicularly oriented, longer module 232 by the gripping action of the arms 296 on the vertical riser surfaces 190 and 252 of modules 172 and 232, respectively. The exterior corner module 284 can be releasably coupled with other combinations (not shown) such as a combination of two of the modules 172 or a combination of two of the longer modules 232.

Figure 15:
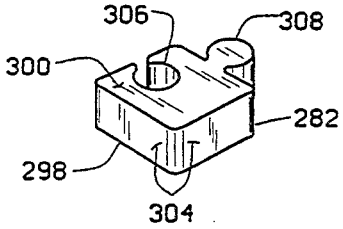
FIG. 15 is a perspective view of the interior corner module of the modular assembly of FIG. 13.

The interior corner module 282, as better shown by FIG. 15, has a square bottom surface 298, a top surface 300 positioned above the bottom surface 298, and a wall 302 interconnecting the bottom surface 298 with the top surface 300. The wall 302 has four generally equal sides 304. The interior corner module 282 has a rounded fantailed groove 306 recessed into one of the four sides 304 of the wall 302, extending vertically between the top surface 300 and bottom surface 298. In addition, the interior corner module 282 has a rounded fan-tailed tongue 308 protruding from another of the four sides 304 that is adjacent and perpendicular to the side 304 that has the groove 306 in it. The tongue 308 extends vertically between the top surface 300 and bottom surface 298. With these tongue and groove provisions 306 and 308, as shown by FIG. 13, the interior corner module 282 can releasably interlink the module 172 with the module 232, in fixed, temporary, right-angle relationships with one another.

Referring once more to FIG. 13, all the upwardly facing surfaces of the several modular components of the modular assembly 280 not only are level, but are generally located in one or another of two characteristic elevations, one higher and the other lower. Accordingly, the top surfaces 178 and 240 of the base modules 172 and 232, respectively, are generally coplanar in the higher elevation. In addition, the exterior corner modules 284 and 286 have their respective top surfaces 290 and 290' likewise coplanar with the higher elevation.

The modular assembly 280, as said, is also characterized by a lower elevation. Typical of the lower elevation is the top surface 300 of the interior corner module 282. Also typical of the lower elevation are the step surfaces 188 and 250 of the base modules 172 and 232, respectively. As for the exterior corner modules 284 and 286, the notches 294 and 294' of each have upwardly facing surfaces 310 and 310', respectively; and these upwardly facing surfaces 310 and 310' generally lie in the lower elevation as well. Thus, the lower of the two characteristic elevations of the modular assembly 280 defines surfaces for children to sit on, such that the modular assembly 280 functions as a modular sofa or the like.

Figure 16:
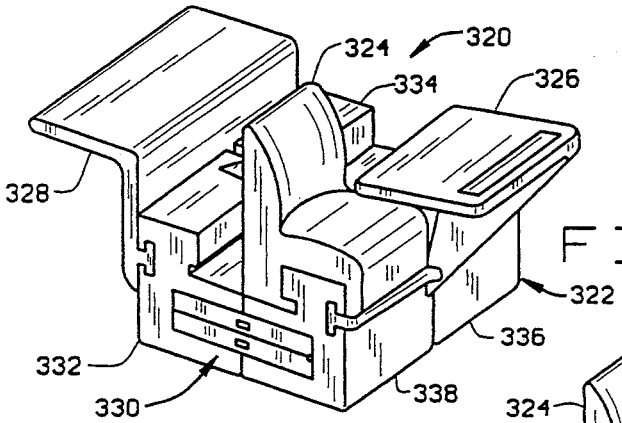
FIG. 16 is an assembly of another embodiment of children's school furniture of the present invention, comprising a modular base assembly releasably coupled with a chair component, two embodiments of a desk component, and a mattress and tray assembly.

Turning now to FIG. 16, an assembly 320 of children's school furniture of the present invention is shown. The assembly 320 of school furniture comprises a modular base assembly 322 releasably coupled with several auxiliary components, namely a chair 324, one embodiment of a desk 326, another embodiment of a desk 328, and a mattress and tray assembly 330. The modular base assembly 322 in turn comprises four modules 332, 334, 336 and 338, mutually coupled together by tongue and groove provisions to be described.

Figure 17:
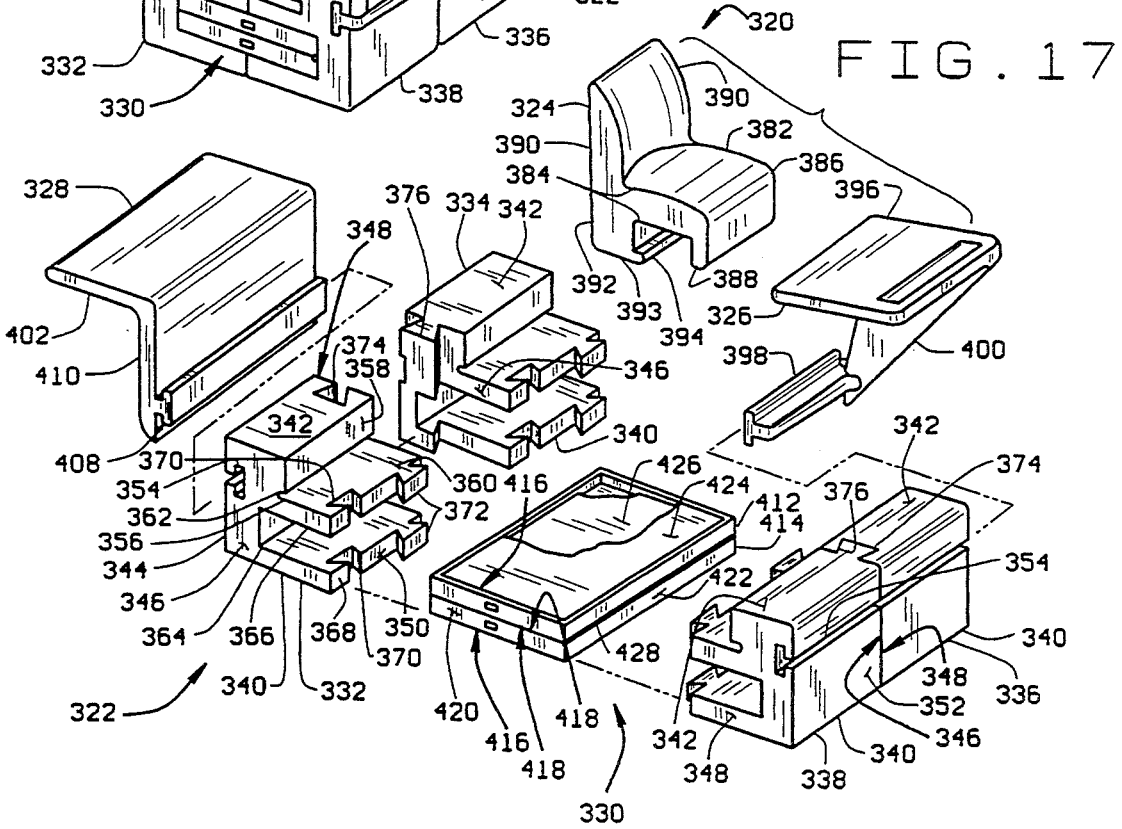
FIG. 17 is an exploded view of FIG. 16.

The lower left module 332, as better shown by FIG. 17, is typical of the other modules 334, 336, and 338 in having the following features, shared among all: the module 332 has a generally rectangular bottom surface 340, a top surface 342 positioned above the bottom surface 340, and a wall 344 interconnecting the bottom surface 340 with the top surface 342. This wall 344 has opposite sides 346 and 348 laterally spaced by opposite sides of which one is an inboard side 350 and the other is an outboard side 352.

The module 332 also has a T-slot 354 recessed into the outboard side 352, extending laterally between the laterally spaced sides 346 and 348. The module 332 further has a notch 356 recessed into one edge. The notch 356 extends laterally between the opposite sides 346 and 348. More particularly, the notch 356 is defined by a vertical riser 358 intersecting a horizontal step 360 along a creased edge 362 that is undercut into the module 332 through the .riser surface 358.

The module 332 further still has an open cavity 364 recessed in the inboard side 350, the open cavity 364 having a rectangular cross-section. The open rectangular cavity 364 extends laterally between the sides 346 and 348. The open rectangular cavity 364 is elevated to about halfway between the bottom surface 340 and the step surface 360 of the notch 356. As a result, little is left of the inboard side 350 except for a pair of vertically spaced portions 366 and 368, positioned respectively above and below the open rectangular cavity 364.

The module 332, still typical of the other three modules 334, 336, and 338, has the inboard side 350 formed with dovetailed tongue and groove provisions. More particularly, the module 332 has a dovetailed groove 370 recessed in the inboard side 350, extending vertically between the bottom surface 340 and step 360. Additionally, the module 332 has a dovetailed tongue 372 protruding from the inboard side 350, extending vertically beside and in spaced, parallel relationships with the dovetailed groove 370, between the bottom surface 340 and step 360.

As previously indicated, all four modules 332, 334, 336, and 338 are alike in having those features described above; they pair off now for features now to be described. As determined by their relative positions in the modular base assembly 322, diagonally opposite modules 332 and 336 are alike, as are diagonally opposite modules 334 and 338. More particularly, diagonally opposite modules 332 and 336 are alike in having a dovetailed groove 374 recessed into side 348 of the laterally spaced sides 346 and 348, extending vertically between the bottom surface 340 and top surface 342. Diagonally opposite modules 334 and 338 are alike, but different from modules 332 and 336, in having a dovetailed tongue 376 protruding from side 346 of the laterally spaced sides 346 and 348, extending vertically between the bottom surface 340 and the top surface 342.

In accordance with all of such tongue and groove provisions described here, the modules 332, 334, 336, and 338 can be releasably coupled together to make the modular base assembly 322, as shown in FIG. 16.

Once assembled, the modular base assembly 322 serves as a platform for supporting several different auxiliary components. One of these auxiliary components, as said, is the chair component 324. The chair component 324 has a vertically extending portion 380, and a chair seat portion 382 merging with the vertically extending portion 380 in a T-intersection 384. The chair seat portion 382 extends forwardly from the T-intersection 384 to a front edge 386, and from the front edge 386 the chair seat portion 382 is turned downwardly to become a front flange 388 extending below the front edge 386. The vertically extending member 380 comprises a chair back portion 390 for the part that extends above the elevation of the T-intersection 384, and further comprises a support column 392 for the other part extending below the elevation of the T-intersection 384. The support column 392 terminates in a bottom surface 393 formed with a forwardly projecting toe 394.

With the features above, the chair component 324 can be releasably coupled with the modular base assembly 322 by the engagement between the bottom surface 393 and any of the typical step surfaces 360 of the modules 332, 334, 336 or 338. Relative positions between the chair component 324 and the module base assembly 322 is maintained by the gripping action between the front flange 388 and the support column 392, as applied to the typical risers 358 and outboard sides 352, as shown by FIG. 16.

The auxiliary components for the modular base assembly 322 also includes desk component 326. The desk component 326 comprises a desk top portion 396, a T-slide provision 398 vertically spaced below the desk top portion 396, and an inclined leg 400 interconnecting the desk top portion 396 with the T-slide provision 398. The desk component 326 can be releasably coupled together with the modular base assembly 322 by the sliding engagement between the T-slide provision 398 and any of the typical T-slots 354 of the modules 332, 334, 336, or 338.

In addition, there is another desk component 328, having an inverted-L cross-section. That is, the desk component 328 has a rectangular desk top portion 402, a T-slide provision 408 spaced below the desk top portion 402, and a vertical leg 410 interconnecting the desk top portion 402 with the T-slide provision 408. With these features, the desk component 328 can be releasably coupled with the modular base assembly 322 by the sliding engagement between the T-slide provision 408 and any of the typical T-slots 354 of the modules 332, 334, 336, and 338.

Still another of the auxiliary components for the modular base assembly 322 is the mattress and tray assembly 330. The mattress and tray assembly 330 has folded in and folded out positions. While folded in, as better shown by FIGS. 17 and 18, the mattress and tray assembly 330 has a rectangular block shape, sized for sliding within the rectangular cavities 364 of the modular base assembly 322 in the manner of a drawer, as shown.

The mattress and tray assembly 330 comprises a pair of rectangular trays 412 and 414 that are substantially the same size. The trays 412 and 414 are similar in having an open end 416 and an opposite closed end 418 spaced apart by a four-sided edge, namely: opposite short sides 420 laterally spaced by opposite long sides 422. The mattress and tray assembly 330 further includes a pair of rectangular mattress pads 424 and 426, sized for storage of both within one or the other of the trays 412 and 414.

The pair of rectangular trays 412 and 414 are hinged together by a hinge 428. The hinged connection permits the trays 412 and 414 to be folded out (not illustrated) by having one of the two trays 412 and 414, in relation to the other, sweep a 180° arc. While folded out the trays 412 and 414 can cover over the modular base assembly 322, as supported conjointly by the respective top surfaces 342 of the individual modules 332, 334, 336 and 338. While covering the modular base assembly 322 the trays 412 and 414 in turn support the pair of mattress pads 424 and 426, to make a bed assembly on which children can recline.

Figure 18:
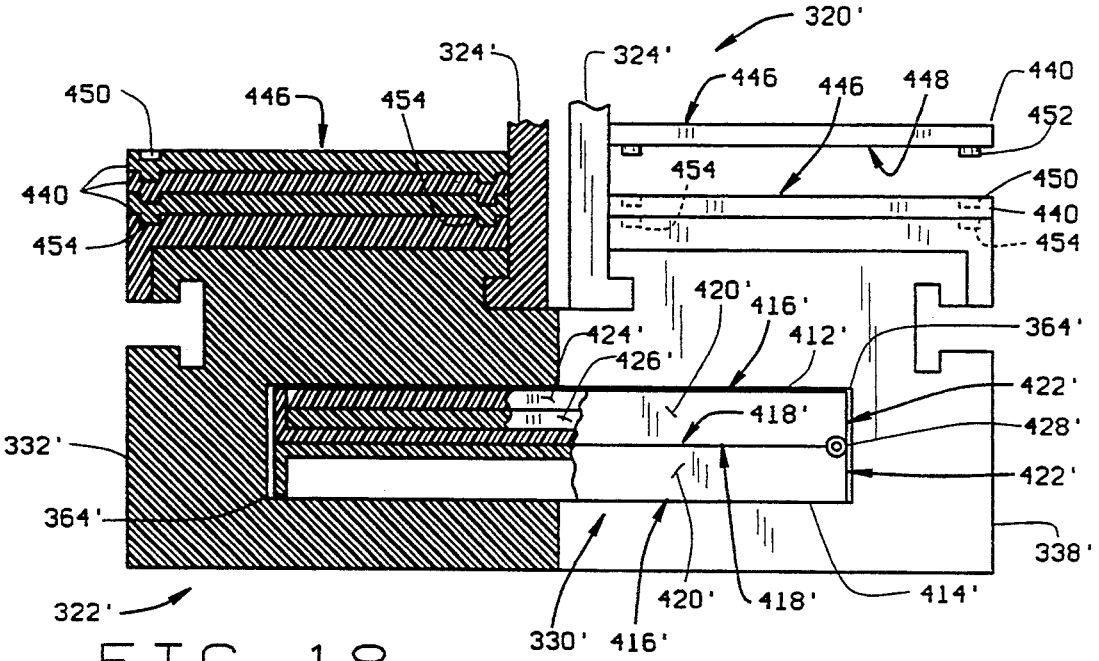
FIG. 18 is generally an enlarged side elevation view of FIG. 16, partly in section and partly broken away.
Figure 19:
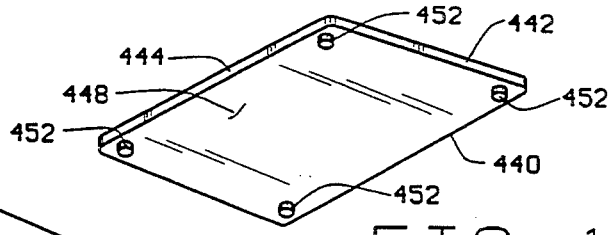
FIG. 19 is a perspective view from below the horizon of the stackable, seat elevator component of FIG. 18.

Turning now to FIGS. 18 and 19, a seat elevator 440 of the present invention is shown, for stacking onto the seat of the chair component 324', to make a higher seat. The seat elevator 440 is a generally rectangular panel with opposite short sides 442 laterally spaced by opposite long sides 444. The seat elevator 440 further has a top surface 446, and a bottom surface 448 interconnected to the top surface 446 by the four sides of the pairs 442 and 444.

The top surface 446 is formed with four dimples 450, while the bottom surface 448 is provided with four stubs 452, correspondingly located for engaging the four dimples 450 of another, like seat elevator 440 while the two elevators 440 are stacked together, as shown in FIG. 18. The chair component 324' of FIG. 18, generally similar to the chair component 324 of FIGS. 16 and 17, has four dimples 454, correspondingly located for reciprocal engagement with the four stubs 452 of the bottom surface 448 of the seat elevator 440 while stacked on the chair component 324'.

Accordingly, the seat elevator 440 releasably stacks together with the chair component 324' to make the seating surface of the chair seat component 324' incrementally higher by the measure of the thickness of the seat elevator 440. The seating surface elevation can be further increased in increments of the thickness of the seat elevator 440 by further stacking seat elevators 440 onto one another, as illustrated in FIG. 18. And so the seat elevator 440 provides the assembly 320 of children's school furniture with an adjustable seating surface elevation, through a range of elevations, in accordance with the different sizes of the children.

Figure 20:
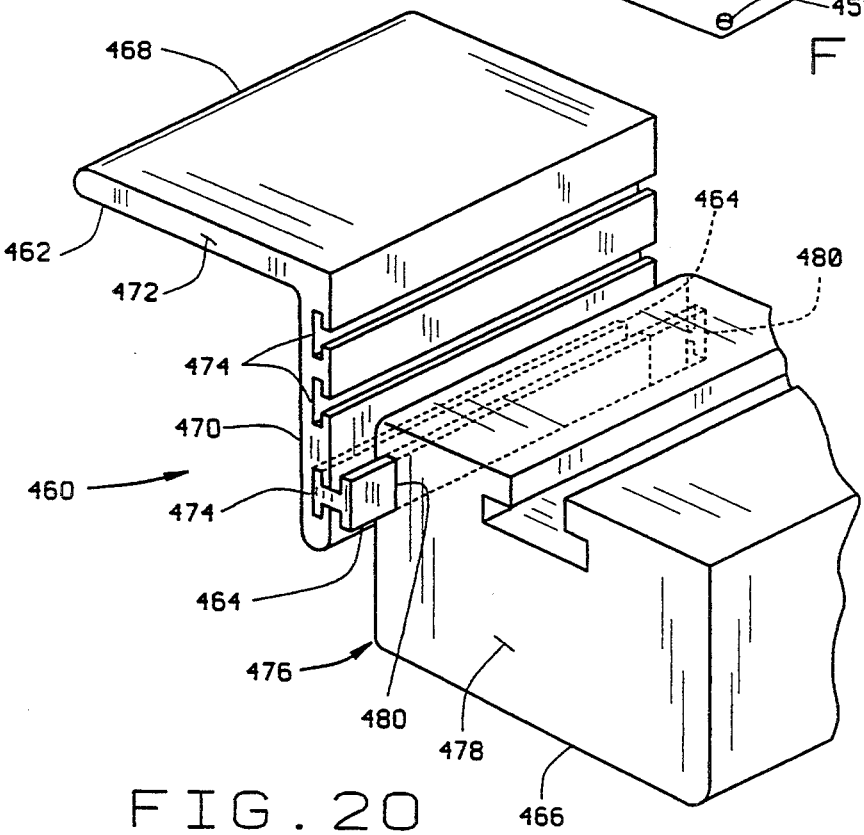
FIG. 20 is a perspective view of an adjustable desk assembly of the present invention, comprising a furniture base releasably joined to another embodiment of a desk component.

Referring now to FIG. 20, yet another desk assembly 460 of the present invention is shown. The desk assembly 460 provides an adjustably high desk component 462, with a slide 464 interconnecting the desk component 462 with a furniture base 466. The desk component 462 has an inverted-L cross-section, with a horizontally extending, rectangular desk top portion 468 and a vertically extending leg 470. The desk component 462 also has opposite, inverted-L edges 472 laterally spaced by both the desk top portion 468 and leg 470. The desk component 462 has three identical horizontal T-slots 474 recessed into the leg 470, extending laterally between the laterally spaced edges 472.

The furniture base 466 of FIG. 20, as representative of the furniture bases and modules described previously, is a rectangular block which has at least one vertical side surface 476 extending laterally between opposite lateral edges 478. The furniture base 466 has a T-slot 480, like the T-slots 474 of the desk component 462, recessed in the side surface 476, extending laterally between the lateral edges 478.

For coupling the desk component 462 and furniture base 466 together, there is the slide 464. The slide 464 is an elongated member that has a cross-section in the shape of two T's connected together by the base of their stems. The slide 464 interlinks the desk component 462 with the base 466 by a pair of sliding engagements: one with the T-slot 480 of the base 466 and the other with any of the T-slots 474 of the desk component 462. Accordingly, the elevation of the rectangular table top 468 is adjustably high among three elevations, by interlinking the base 466 among any particular one of the three T-slots 474.

To speak of the materials of composition for the foregoing components, they are to be made of materials which render them suitably lightweight. More specifically, as a general category, the furniture bases should be suitably lightweight for a child to slide across the floor by pushing thereon; while the auxiliary components, in their own general category, should be suitably lightweight for a child to lift up to the top of a furniture base, for coupling the auxiliary component with the furniture base. Indeed, children should be able to slide these furniture bases and lift these auxiliary components without an adult's help.

While the present invention has been described by reference to specific embodiments, it should be understood that modifications and variations of the invention may be constructed without departing from the scope of the invention defined in the following claims.

What is claimed is:

1. A combination of components for building assemblies of children's furniture; the combination of components comprising:

a base for sitting on a floor, the base having an upper surface for bench-style seating thereon, and a side wall generally lower than the upper surface, the side wall having a portion that extends laterally between opposite lateral edges; the base further having means to engage the floor for rigidly supporting the upper surface and side wall in relative positions, and a groove recessed into said portion, extending laterally between the opposite lateral edges;

a desk auxiliary component for releasably coupling with the base to build a desk assembly, the desk auxiliary component having a desk top portion and a support leg subjoined to the desk top portion, the support leg extending laterally between opposite lateral ends, the support leg having a surface for opposing said portion of the side wall, said surface extending laterally between the opposite lateral ends, the support leg further having parallel grooves recessed into said surface, extending laterally between the opposite lateral ends; and a slide for interconnecting the base and the desk auxiliary component by mutually engaging the groove of the base and any of the grooves of the desk auxiliary component whereby the elevation of the desk top portion is adjustable relative to the upper surface of the base.

2. A component assembly for building assemblies of children's furniture; the components comprising:

a base having an upper surface, means to engage a floor for supporting the upper surface above the floor, a recess formed in the upper surface, and a side wall generally lower than the upper surface, the side wall having a portion that extends laterally between opposite lateral edges; the base further having a groove recessed into said portion, extending laterally between the opposite lateral edges; said supporting means of the base further supporting the upper surface and side wall in rigid, relative positions;

a plurality of auxiliary components for releasably coupling to the base to build a variety of assemblies, each auxiliary component having a main body and having a stem of a shape and size complementary to the shape and size of the recess to enable the stern to be slid into the recess for releasable support of the auxiliary component by and with its main body projecting from the base to thereby build at least a portion of one of a plurality of assemblies;

a desk auxiliary component for releasably coupling with the base to build a desk assembly, the desk auxiliary component having a desk top portion and a support leg subjoined to the desk top portion, the support leg having a surface for opposing said portion of the side wall, said surface extending laterally between opposite lateral ends, the support leg further having a plurality of parallel grooves recessed into said surface, extending laterally between the opposite lateral ends; and a slide for interconnecting the base and desk auxiliary component by mutually engaging the groove of the base and any of the grooves of the desk auxiliary component, whereby the elevation of the desk top portion is adjustable relative to the elevation of the upper surface of the base.

3. Children's furniture for school-related purposes, the children's furniture comprising:

a module comprising:

(1) an upper surface, (2) opposite inboard and outboard sides laterally extending between opposite lateral margins, (3) a notch recessed into the module, interposed between the upper surface and the inboard side, (4) means to engage a floor for supporting the upper surface and the inboard and outboard sides in rigid, relative positions, (5) tongue-and-groove means formed with the inboard side, whereby one module can releasably couple with another like module by the mutual engagements between the respective tongue-and-groove means for building a modular assembly of a furniture base that in turn can be releasably coupled with auxiliary components to build different assemblies of children's furniture, and (6) an open cavity, recessed into the inboard side, extending laterally between the opposite lateral margins, wherein the cavity of said module associates with the cavity of another like module to define a channel recessed laterally into an assembly of said modules; and a mattress and support assembly having folded in and folded out positions, the mattress and support assembly being sized and shaped for, while folded in, storage in the channel of the modular assembly and, while folded out, for covering over the modular assembly by engaging the upper surfaces of the respective modules of the modular assembly, thereby building a bed assembly for children to recline thereon.

4. Modular styled furniture suitable for combining a multiple of modules into a plurality of furniture combinations, each combination comprising:

a base assembly comprising at least two separate base modules, each of the base modules having top and side surfaces, a recess in at least one of the top and side surfaces, and integral coupling means releasably interlocking the base modules together, each of the base module recesses being positioned on each base module to form a continuous recess when the base modules are interlocked, thereby forming a base assembly recess having a length extending between the base modules;

at least one auxiliary component having a stem of a size and shape complementary to the size and shape of the base assembly recess, the auxiliary component being releasably coupled to the base assembly by the stem being inserted into the base assembly recess in a direction parallel to the length of the base assembly recess;

the auxiliary component comprises a desk with the stem attached thereto;

the desk has a plurality of vertically spaced slots for releasably engaging the desk stem, thereby permitting vertical adjustment of the desk by selectively inserting the stem in one of the plurality of slots.

5. The modular combination of claim 4 wherein a second auxiliary component comprises a chair.

6. The modular combination of claim 4 wherein the base assembly recess comprises a notch with a creased edge.

7. The modular combination of claim 4 wherein the base assembly recess has a T-shaped cross section.

8. The modular combination of claim 4 further comprising:

a cavity recessed into at least one of the side surfaces of each base module, the cavities being positioned in the side surfaces of the base modules where the cavities of two interlocked base modules oppose each other forming an open channel through the interlocked base modules; and a tray assembly for slidably engaging the open channel.

* * * * *